US007490552B1

(12) United States Patent
Jean et al.

(10) Patent No.: US 7,490,552 B1
(45) Date of Patent: Feb. 17, 2009

(54) MEMS MICRODETONATOR/INITIATOR APPARATUS FOR A MEMS FUZE

(75) Inventors: Daniel Jean, Odenton, MD (US); Michael Beggans, Waldorf, MD (US); Gerald Laib, Olney, MD (US); David Olson, Chesapeake Beach, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 45 days.

(21) Appl. No.: 11/894,629

(22) Filed: Jul. 31, 2007

(51) Int. Cl.
*F42C 15/26* (2006.01)

(52) U.S. Cl. ..... 102/231; 200/61.08; 361/251; 102/221; 102/202.5

(58) Field of Classification Search ..... 200/61.08; 361/251
See application file for complete search history.

(56) References Cited

U.S. PATENT DOCUMENTS 6,173,650 B1 1/2001 Garvick et al.
6,431,594 B1 8/2002 Swann et al.
6,584,911 B2 7/2003 Bergerson et al.
6,640,719 B1 11/2003 Pacella et al.
6,964,231 B1 11/2005 Robinson et al.
6,986,307 B2 1/2006 Bernhard et al.
7,051,656 B1 * 5/2006 Koehler et al. ..... 102/249
7,383,774 B1 * 6/2008 Koehler et al. ..... 102/249
2005/0183609 A1 * 8/2005 Greywall ..... 102/247
2006/0070547 A1 4/2006 Combes et al.
2006/0236887 A1 * 10/2006 Childs et al. ..... 102/272

* cited by examiner

*Primary Examiner*—James S Bergin
*Assistant Examiner*—Samir Abdosh
(74) *Attorney, Agent, or Firm*—Frederic J. Zimmerman

(57) ABSTRACT

A MEMS apparatus having a substrate layer, a device layer and an intermediate oxide layer joining them. A slider is formed in the device layer and includes an enlarged end portion. A walled chamber having a hollow interior in which is positioned a microdetonator is formed in the substrate layer beneath the enlarged end portion and is secured to it by the oxide layer. A drive is operable to move the slider, and with it, the walled chamber, from an initial position to a final position. When in the final position an initiator is operable to initiate the microdetonator.

9 Claims, 9 Drawing Sheets

MEMS MICRODETONATOR/INITIATOR APPARATUS FOR A MEMS FUZE

STATEMENT OF GOVERNMENT INTEREST

The invention described herein may be manufactured and used by or for the Government of the United States of America for Governmental purposes without the payment of any royalties thereon or therefor.

BACKGROUND OF THE INVENTION

1) Field of the Invention

The invention in general relates to MEMS (microelectromechanical systems) devices and more particularly to a MEMS device utilized in the explosive train to set off a main charge of a munitions round.

2) Description of the Related Art

A fuze is a device designed to set off an explosive train in a munitions round such as a mortar round, artillery shell or rocket warhead, by way of example. In general, three components of the fuze: the explosive, the initiator and safety locks, have been fabricated individually and then assembled in a package.

The safety components are mechanical devices built from multiple machined parts and assembled into complex intricate mechanisms. Although the initiator has been miniaturized, it is still a separate part of the fuze. The explosive has always been formed apart from all other parts and then carefully assembled with the other components to make a functional fuze.

SUMMARY OF THE INVENTION

It is an object of the invention to provide a MEMS assembly in which is integrated all of the components parts of a fuze.

A MEMS microdetonator/initiator arrangement for a MEMS fuze in accordance with the invention includes a bottom substrate layer, a top device layer and an intermediate oxide layer joining the top and bottom layers. A slider is defined in the device layer and has an end portion, with the portion of slider adjacent to the end being devoid of any underlying oxide layer so as to permit movement thereof relative to the substrate layer. A slider drive is operable to move the slider from an initial position to a final position. A walled chamber is defined in the substrate layer and is connected to the enlarged end portion of the slider by the oxide layer. The substrate layer adjacent the walled chamber is removed to allow movement of the walled chamber.

The walled chamber has a hollow interior extending to the underside of the enlarged end portion of the slider, with a microdetonator being positioned within the hollow interior of the walled chamber. The substrate layer includes a void adjacent the walled chamber to allow movement of the walled chamber into the void when the slider is moved by the drive to the final position. An initiator is positioned so that when the slider is in the final position, the initiator, when supplied with current, is operable to initiate the microdetonator.

BRIEF DESCRIPTION OF THE DRAWINGS

In the drawings, which are not necessarily to scale, like or corresponding parts are denoted by like or corresponding reference numerals.

DETAILED DESCRIPTION OF AN EXEMPLARY EMBODIMENT OF THE INVENTION

Figure 1A:
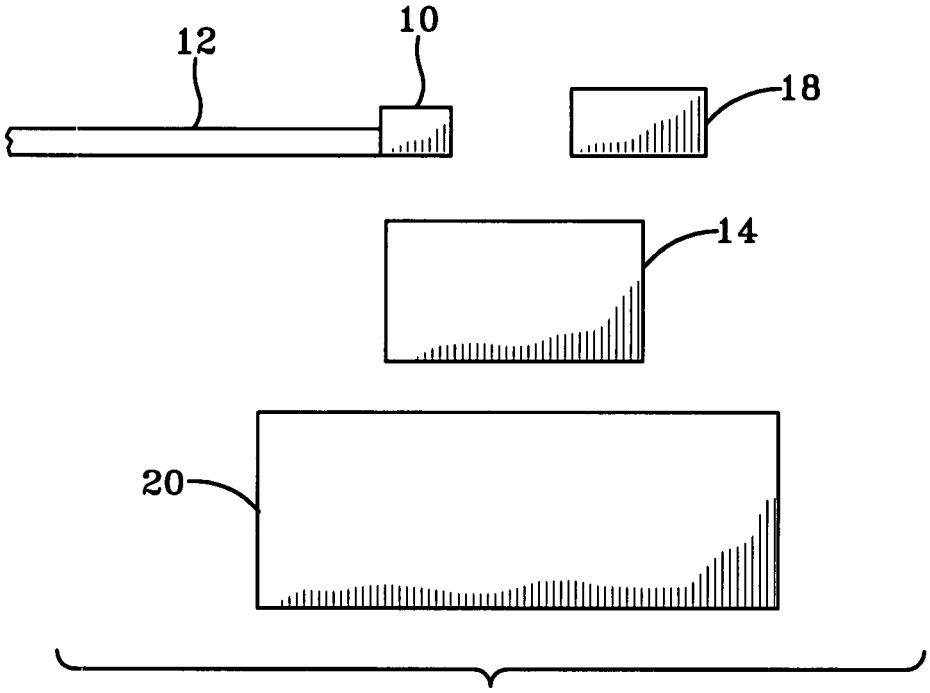
FIGS. 1A and 1B illustrate the operation of a microdetonator.
Figure 1B:
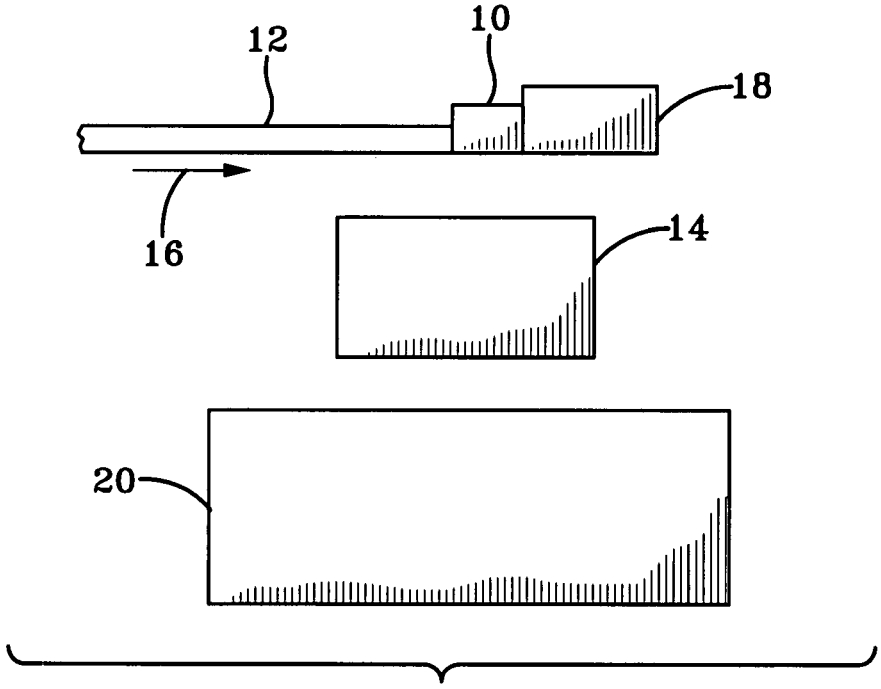

FIGS. 1A and 1B illustrate a microdetonator and its placement for initiating an explosive train. In FIG. 1A, a microdetonator 10 is carried by a slider 12 and is in an initial first position insufficient to set off a secondary explosive 14, also known as a secondary lead. When the slider 12 moves to the right as indicated in FIG. 1B by arrow 16 to a final position, microdetonator 10 will be adjacent and may be in contact with an initiator 18 and directly above secondary lead 14, whereupon the microdetonator 10 may be initiated, or detonated by the initiator 18. Secondary lead 14 is initiated by the microdetonator 10 and will set off a main explosive charge 20, which is the main charge of the munitions round in which the apparatus is imbedded. Movement of slider 12 may be inertial, such as upon impact with a target or, in an exemplary embodiment, may be mechanically driven.

Figure 2:
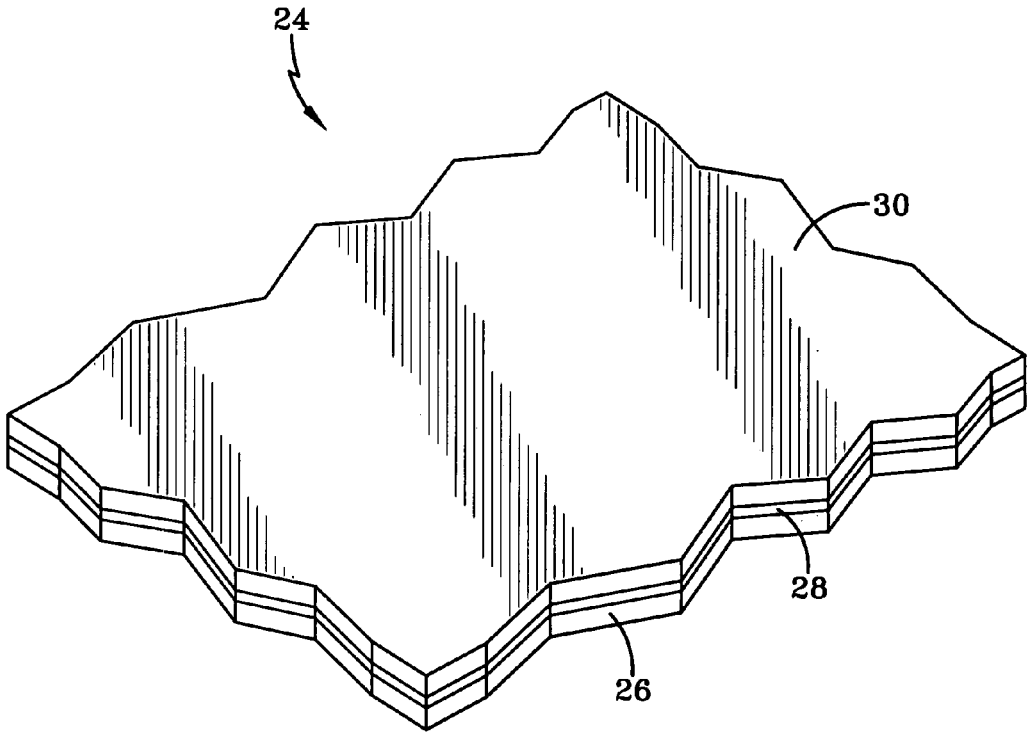
FIG. 2 illustrates an SOI (silicon on insulator) wafer prior to fabrication of the MEMS device of the present invention.

FIG. 2 illustrates a portion of an SOI wafer 24 from which the MEMS fuze assembly and microdetonator/initiator arrangement of the present invention may be fabricated. The structure of FIG. 2 includes a silicon substrate 26 (also known as a handle layer) covered by an insulating, or intermediate layer 28, such as silicon dioxide, over which is bonded or deposited another silicon layer 30, also known as the device layer, which is the layer from which the MEMS fuze assembly and components of the present invention will be fabricated.

The components of the MEMS apparatus described herein may be formed by a DRIE (deep reactive ion etching) process that removes unwanted portions of device layer 30. The DRIE process is a well-developed micromachining process used extensively with silicon based MEMS devices. For this reason, in an exemplary embodiment, silicon is a material for the MEMS fuze assembly of the present invention, although other materials are possible.

Figure 3A:
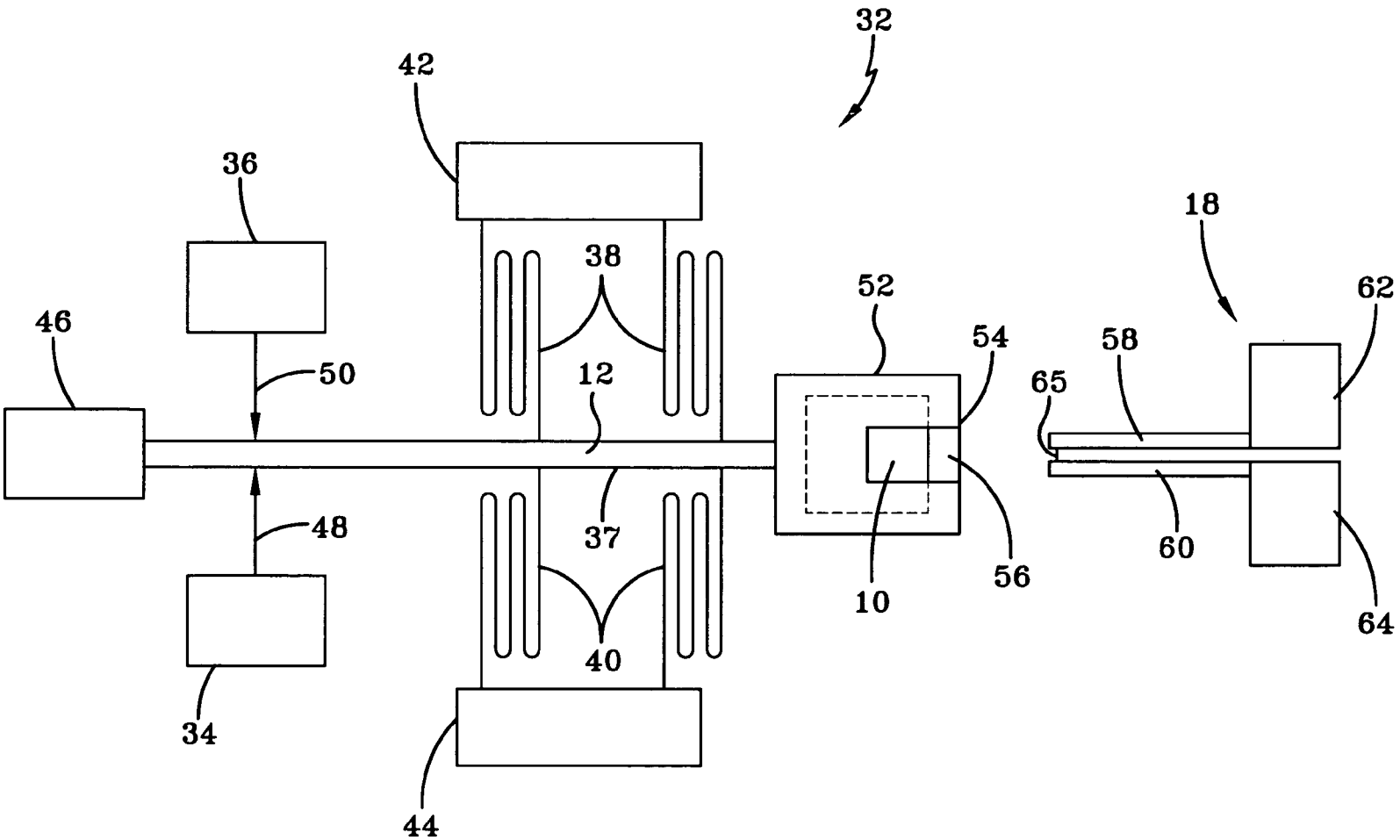
FIGS. 3A and 3B illustrate the operation of an embodiment of a slider.
Figure 3B:
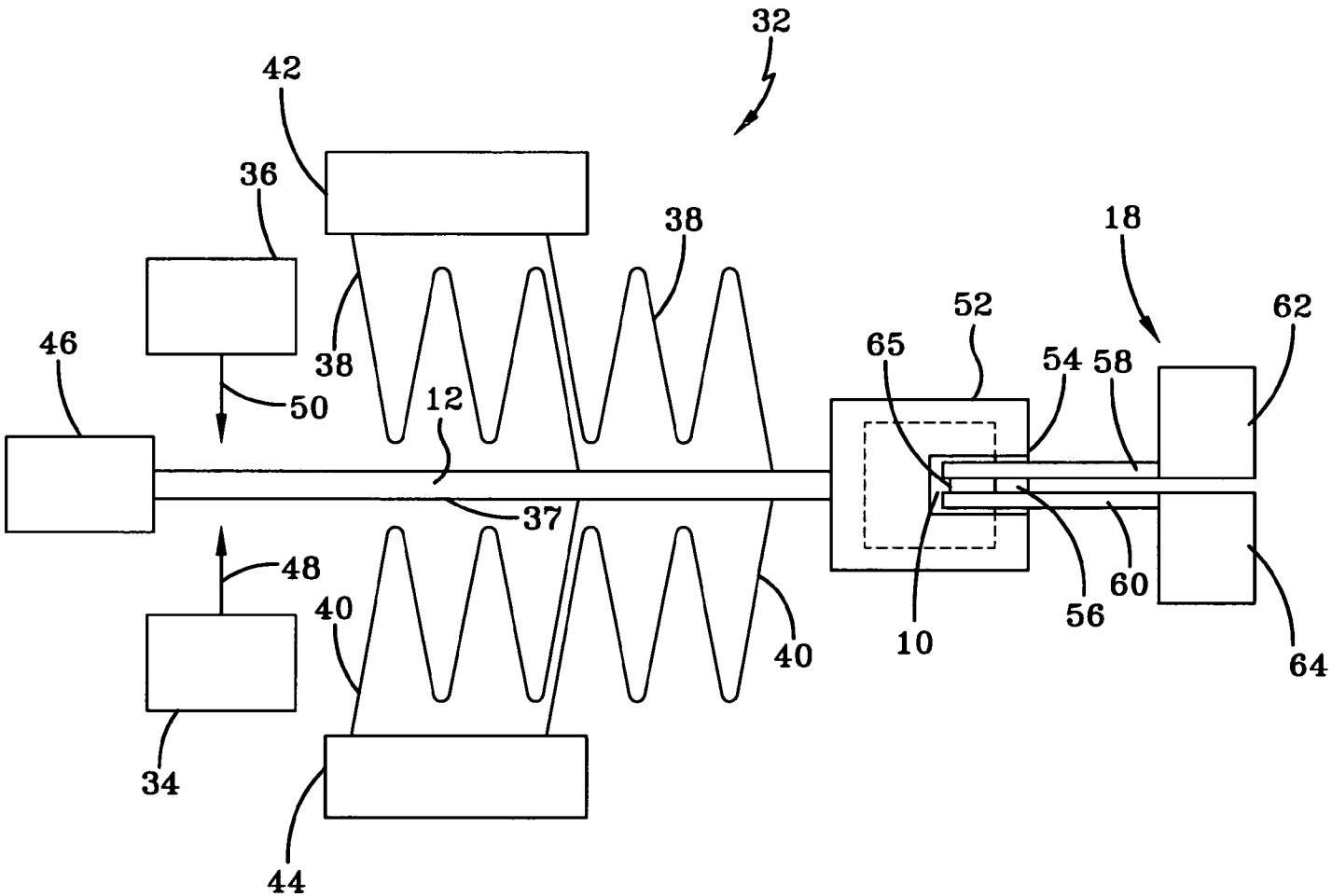

One embodiment of the present invention is illustrated in FIGS. 3A and 3B. The MEMS fuze 32 in FIG. 3A includes slider 12 which, in an exemplary embodiment, as will be described, is driven mechanically, as opposed to inertially. As a safety precaution however, and in accordance with safety regulations, movement of the slider 12 is initially prevented by a series of locks that are released upon attainment of certain predetermined conditions. By way of example, the arrangement includes a setback-activated lock 34 and a spin activated lock 36.

The slider 12 is supported by spring sets 38 and 40 connected to respective anchors 42 and 44, and is mechanically moved by driver 46, which may be a thermoelectric actuator. Slider 12 is prevented from movement until certain predetermined conditions are met. More particularly, locking arms 48 and 50 of locks 34 and 36 are in interlocking engagement and prevent movement of slider 12 until withdrawn. Withdrawal of locking arm 48 may occur upon attainment of a certain axial acceleration force and withdrawal of locking arm 50 may occur upon attainment of a certain centrifugal acceleration.

Slider 12 includes an end portion 52, which, by way of example, is enlarged relative to the remaining portion of slider 12. Enlarged end portion 52 includes a notch 54. The microdetonator 10 may be seen through the notch 54, as well as a wall 56 of the container for the microdetonator 10. Initiator 18 includes initiator arms 58 and 60 connected to respective anchors 62 and 64. The ends of initiator arms 58 and 60 are connected by a thin section 65 of semiconductor such that when a voltage is applied to one of the anchors, current through the thin section 65 will generate sufficient heat to initiate microdetonator 10.

To operate as a MEMS fuze, the thin portion of slider 12, as well as springs and other components must be free to move and therefore must be devoid of any underlying silicon dioxide insulating layer 28 (FIG. 2). One well-known way to accomplish the removal of the underlying insulating layer is by applying an etchant such as hydrofluoric acid that will dissolve the silicon dioxide under these components.

After the munitions round has been fired and the locking arms 48 and 50 disengaged, driver 46 will move slider 12 to the final position illustrated in FIG. 3B whereupon the microdetonator 10 may be set off by initiator 18.

Figure 4A:
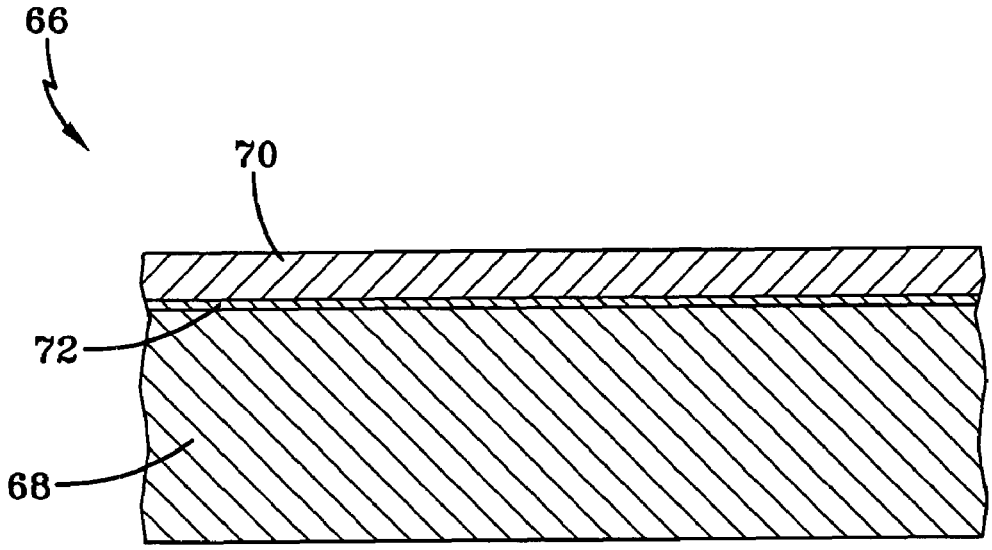
FIGS. 4A to 4D illustrate certain fabrication steps which may be utilized herein.

FIGS. 4A to 4D illustrate a fabrication process for forming the enlarged end portion 52 of slider 12 and for forming the container for microdetonator 10. The views are taken looking in at the end of slider 12. In FIG. 4A, SOI wafer 66 includes a substrate layer 68, a device layer 70 and an oxide layer 72 joining them together where the oxide layer 72 is intermediate the substrate layer 68 and the device layer 70. By way of example, in an exemplary embodiment, substrate layer 68 may have a thickness of 500 μm (microns), device layer 70 a thickness of 100 μm and oxide layer 72, a thickness of 2 μm.

Figure 4B:
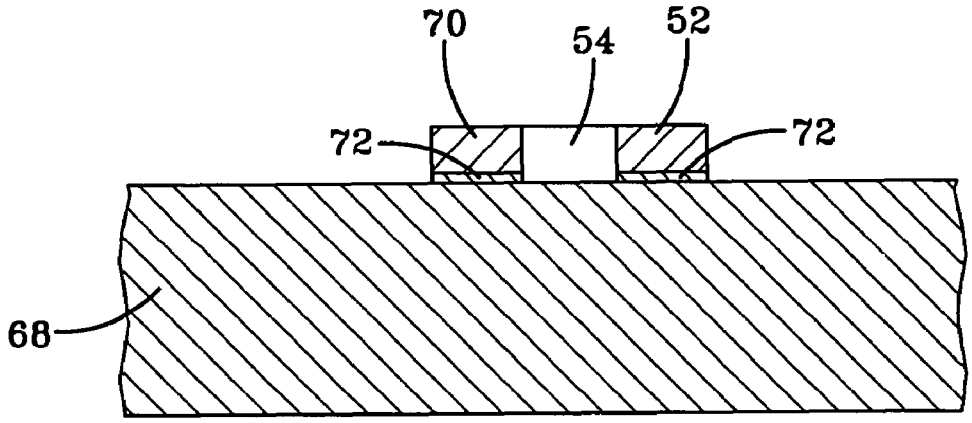
Figure 4C:
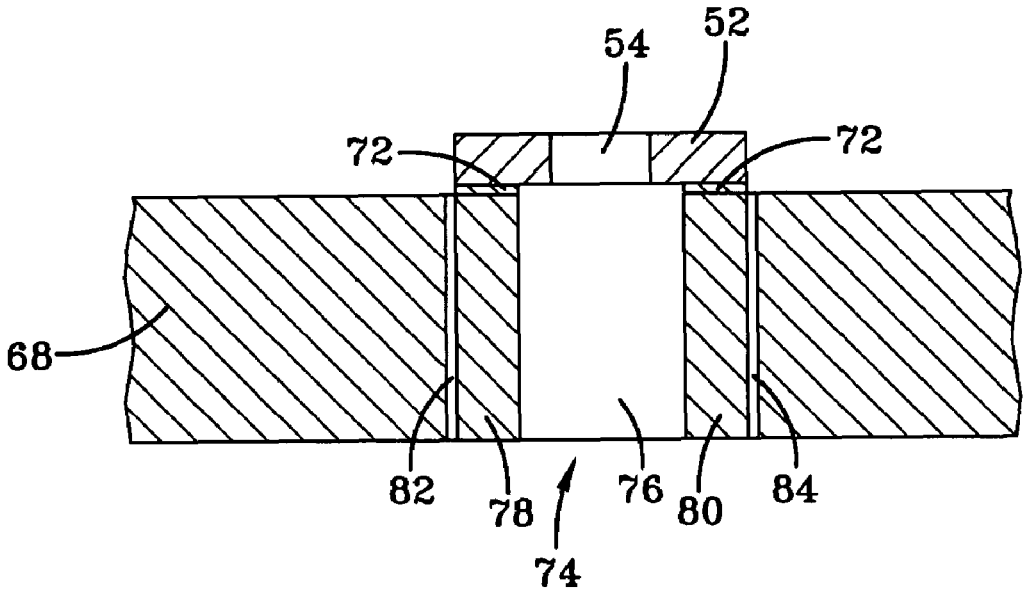

As illustrated in FIG. 4B, device layer 70 has been suitably masked and etched to form enlarged end portion 52 of slider 12, as well as notch 54. With the present invention not only is the top of wafer 66 etched, but the bottom is etched as well. Thus in FIG. 4C, the etching process has formed a walled chamber 74 having a hollow interior 76 extending up to the bottom of enlarged end portion 52. The chamber 74 by way of example has four walls, two of which, 78 and 80 can be seen in FIG. 4C. Although a four-walled chamber is illustrated, it is to be understood that other shapes, such as cylindrical, are possible.

Figure 4D:
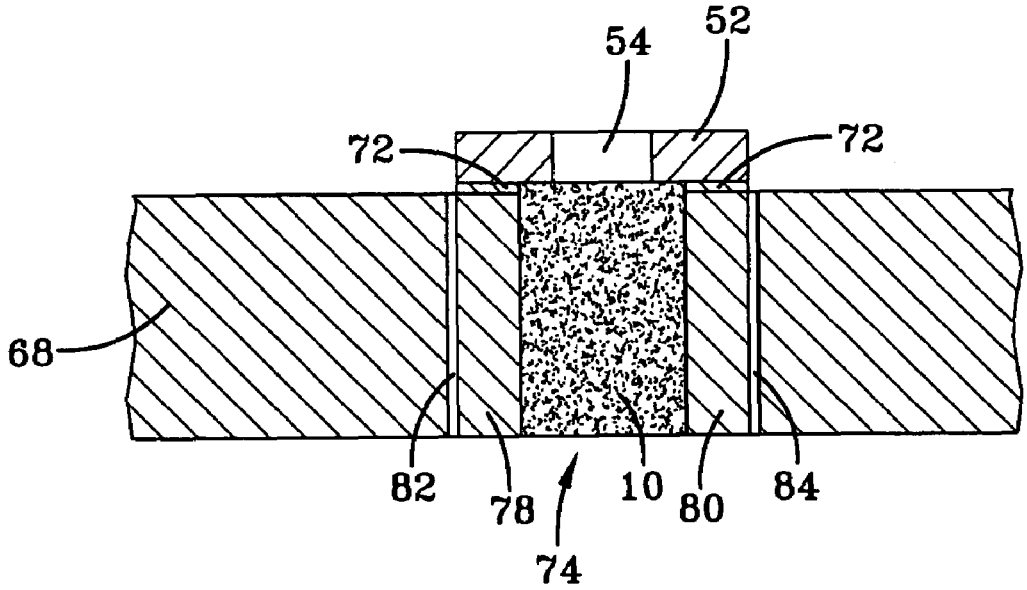

Thin etched sections 82 and 84 extending all the way through the substrate 68 ensure that the walled chamber 74 is free to move relative to substrate 68 (a similar thin section is also etched at the unseen back of chamber 74). Chamber 74 remains connected to enlarged end portion 52 by virtue of the oxide layer 72 and may move with it. After formation of chamber 74, microdetonator 10 is formed or placed within hollow interior 76, as seen in FIG. 4D.

Figure 5:
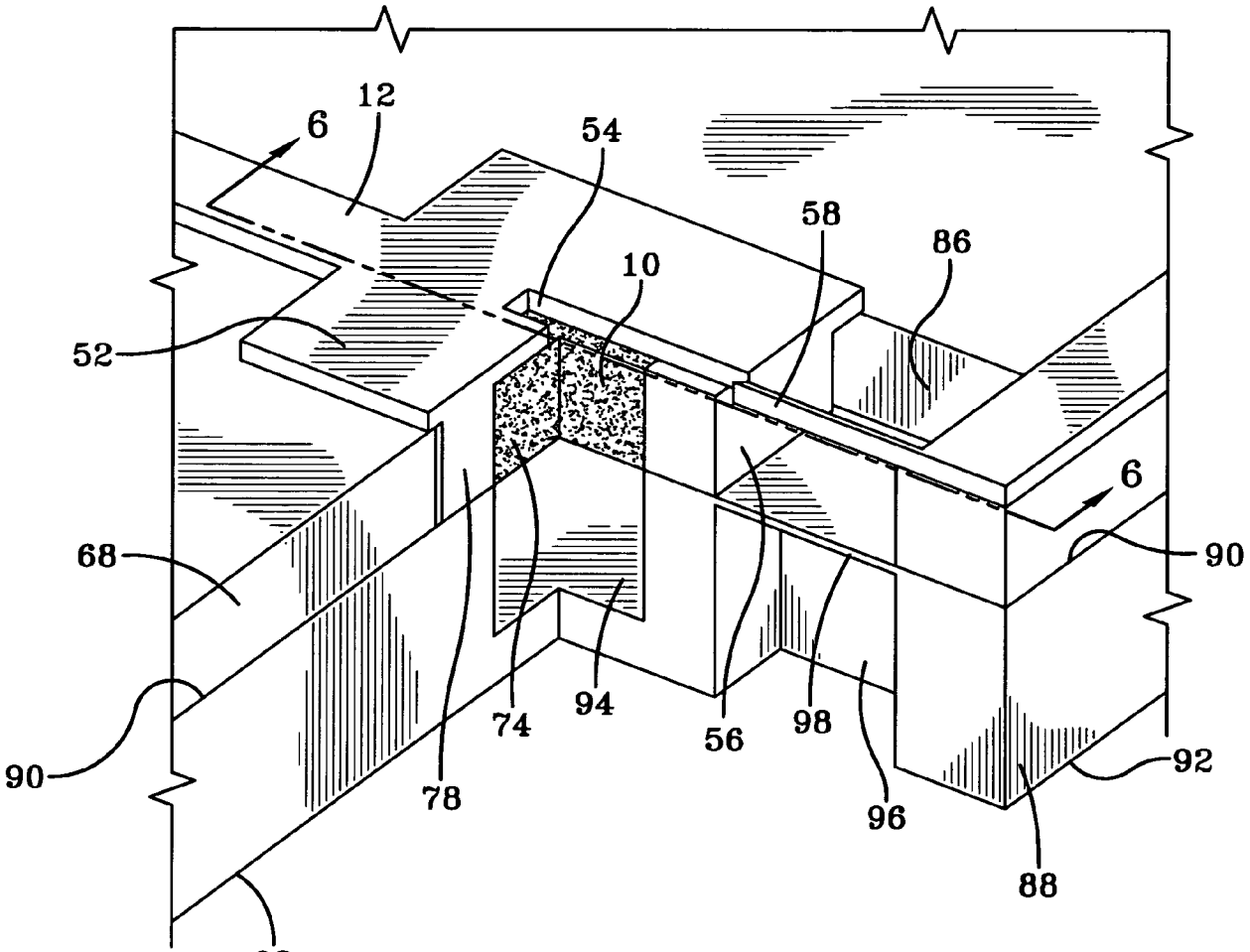
FIG. 5 is a sectional view of a portion of the slider.
Figure 6:
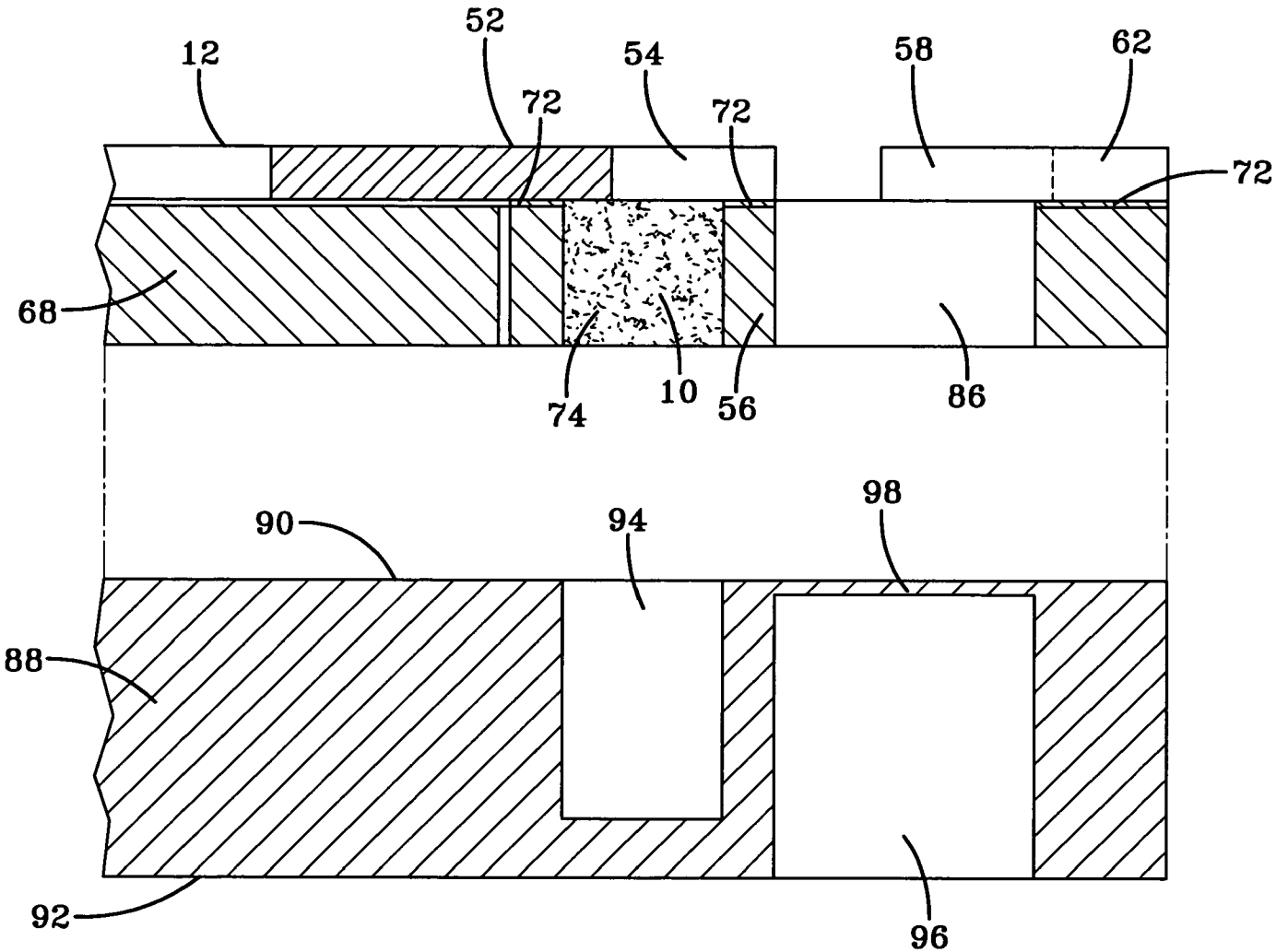
FIG. 6 is a cross-sectional view along the line 6-6 of FIG. 5.

FIG. 5 is a sectional perspective view of the invention and shows the chamber 74 filled with microdetonator 10, and connected to enlarged end portion 52 of slider 12. In order to allow slider 12 to move to a final position for initiation of microdetonator 10, a void 86 is etched in substrate 68 to accommodate movement of chamber 74. The arrangement may optionally include an additional base layer 88, which may be of silicon, bonded to the undersurface of substrate 68 and having a top surface 90 and a bottom surface 92. With additional reference to FIG. 6, which is an exploded view along line 6-6 of FIG. 5, the top surface 90 of base layer 88 is etched down to form a first cavity 94 which is positioned directly below microdetonator 10. This cavity 94 forms an expansion chamber in the event that microdetonator 10 ignites prematurely in its initial position.

The bottom surface 92 of base layer 88 is etched upward to a degree to form a second cavity 96 that leaves a thin membrane 98 at the top surface 90. The secondary lead (not illustrated) is positioned directly below cavity 96. When slider 12 and microdetonator 10 are in a final position for initiation and the microdetonator 10 explodes, it will rupture thin membrane 98 and propel its fragments down into the secondary lead to initiate it, which then initiates the main charge (not illustrated).

Figure 7:
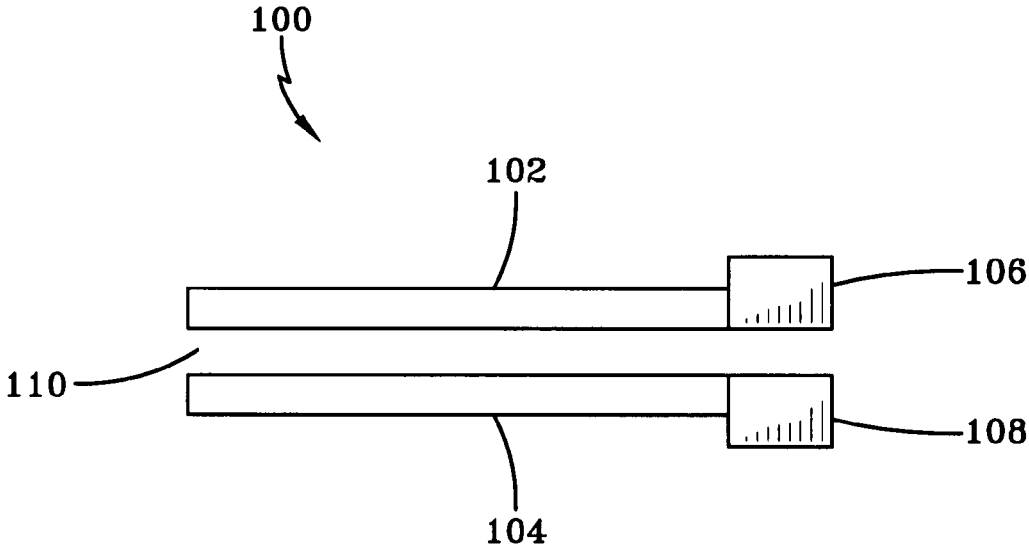
FIG. 7 is a view of an alternate initiator.

FIG. 7 illustrates an alternate form of initiator. Initiator 100 in FIG. 7 includes first and second initiator arms 102 and 104 connected to respective anchors 106 and 108. As opposed to a thin section joining the ends of the initiator arms, as in FIG. 3A, the arrangement of FIG. 7 includes initiator arms 102 and 104 which are spaced apart at the ends to define an open gap 110. Accordingly, initiator arms 102 and 104 are substantially parallel to each other. When a voltage is applied, a spark may be generated at the gap 110 sufficient to initiate the microdetonator 10.

It will be understood that many additional changes in the details, materials, steps and arrangement of parts, which have been herein described and illustrated in order to explain the nature of the invention, may be made by those skilled in the art within the principle and scope of the invention as expressed in the appended claims.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. A MEMS microdetonator/initiator apparatus for a MEMS fuze, comprising:

a bottom substrate layer, a top device layer and an intermediate oxide layer joining said top and bottom layers;

a slider defined in said top device layer with said slider including an enlarged end portion, wherein said slider comprises a portion adjacent said end portion devoid of any underlying said intermediate oxide layer so as to permit movement thereof relative to said bottom substrate layer;

a slider drive operable to move said slider from an initial position to a final position;

a walled chamber being defined in said bottom substrate layer where said walled chamber is connected to said enlarged end portion of said slider by said intermediate oxide layer, wherein said bottom substrate layer, which is adjacent said walled chamber, is removed to allow movement of said walled chamber, and wherein said walled chamber comprises a hollow interior extending to an underside of said enlarged end portion;

a microdetonator being positioned within said hollow interior of said walled chamber, wherein said bottom substrate layer includes a void adjacent said walled chamber to allow movement of said walled chamber into said void when said slider is moved by said drive to said final position; and an initiator being positioned so that when said slider is in said final position, said initiator, when supplied with voltage, is operable to initiate said microdetonator.

2. The apparatus according to claim 1, wherein said slider includes a relatively thin portion and an enlarged end portion.

3. The apparatus according to claim 1, wherein said walled chamber comprises four walls.

4. The apparatus according to claim 1, wherein said initiator comprises two initiator arms connected by a relatively thin section of conductor at the ends thereof, and wherein when said initiator is supplied with voltage said relatively thin section of conductor is heated to a degree sufficient to initiate said microdetonator.

5. The apparatus according to claim 1, further comprising a base layer, said base layer comprises a top surface and a bottom surface, wherein said bottom substrate layer comprises an undersurface bonded to said top surface.

6. The apparatus according to claim 5, wherein said base layer includes a first cavity formed from said top surface and extends into said base layer, and wherein said first cavity is positioned below said microdetonator when said slider is in said initial position.

7. The apparatus according to claim 5, wherein said base layer includes a second cavity formed from said bottom surface and extends into said base layer to a depth so as to leave a thin membrane at said top surface, and wherein said thin membrane is positioned below said void.

8. The apparatus according to claim 4, wherein said slider comprises an enlarged portion, said enlarged end portion includes a slot, and wherein said two parallel initiator arms are positioned within said slot when said slider is in said final position.

9. The apparatus according to claim 1, wherein said initiator includes a first initiator arm and a second initiator arm with an open gap at ends of said first initiator arm and said second initiator arm, and wherein said initiator is supplied with a voltage so that a spark is generated at said open gap to initiate said microdetonator.

* * * * *